US009056222B2

(12) United States Patent
Thomason et al.

(10) Patent No.: US 9,056,222 B2
(45) Date of Patent: Jun. 16, 2015

(54) TOTAL BODY EXERCISE DEVICE

(71) Applicants: Rodger Dale Thomason, Santa Monica, CA (US); William Patrick Conley, Long Beach, CA (US)

(72) Inventors: Rodger Dale Thomason, Santa Monica, CA (US); William Patrick Conley, Long Beach, CA (US)

(73) Assignee: ROCKET INNOVATIONS, LLC, North Hollywood, CA (US)

( * ) Notice: Subject to any disclaimer, the term of this patent is extended or adjusted under 35 U.S.C. 154(b) by 179 days.

(21) Appl. No.: 13/675,833

(22) Filed: Nov. 13, 2012

(65) Prior Publication Data

US 2014/0135189 A1 May 15, 2014

(51) Int. Cl.

| | |
|---|---|
| ***A63B 71/00*** | (2006.01) |
| ***A63B 26/00*** | (2006.01) |
| ***A63B 23/16*** | (2006.01) |
| ***A63B 23/12*** | (2006.01) |
| ***A63B 21/00*** | (2006.01) |

(52) U.S. Cl.

CPC ..... *A63B 23/1236* (2013.01); *A63B 21/1469* (2013.01); *A63B 2225/093* (2013.01)

(58) Field of Classification Search

CPC ..... A63B 23/1236; A63B 23/12; A63B 23/1209; A63B 23/1227

USPC ..... 482/44–50, 141–142, 145–146

See application file for complete search history.

(56) References Cited

U.S. PATENT DOCUMENTS

| | | | | |
|---|---|---|---|---|
| 4,739,986 | A * | 4/1988 | Kucharik et al. | 482/79 |
| 4,801,140 | A * | 1/1989 | Bergeron | 482/146 |
| 5,683,337 | A | 11/1997 | Zetocha | |
| 5,810,703 | A * | 9/1998 | Stack | 482/146 |
| 6,027,435 | A * | 2/2000 | Nadorf et al. | 482/146 |
| 6,692,419 | B2 * | 2/2004 | Chen | 482/146 |
| 6,695,755 | B1 * | 2/2004 | Huang | 482/146 |
| 6,730,005 | B1 * | 5/2004 | Liao | 482/142 |
| 7,008,360 | B1 * | 3/2006 | Smith | 482/146 |
| 7,137,938 | B2 * | 11/2006 | Gottlieb | 482/146 |
| 7,357,766 | B2 * | 4/2008 | Langer et al. | 482/146 |
| 7,374,517 | B2 * | 5/2008 | Lockett | 482/131 |
| 7,377,888 | B2 | 5/2008 | Godbold | |
| 7,468,025 | B2 | 12/2008 | Hauser | |
| 7,591,774 | B1 * | 9/2009 | Tien | 482/147 |
| 7,753,831 | B2 * | 7/2010 | Langer et al. | 482/146 |
| 7,806,807 | B2 * | 10/2010 | Genua | 482/51 |
| 2004/0018924 | A1 * | 1/2004 | Szydlowski et al. | 482/146 |
| 2004/0023766 | A1 * | 2/2004 | Slone | 482/146 |
| 2012/0004082 | A1 | 1/2012 | Senegal | |
| 2012/0040811 | A1 * | 2/2012 | DeTore | 482/141 |

* cited by examiner

*Primary Examiner* — Stephen Crow
*Assistant Examiner* — Garrett Atkinson
(74) *Attorney, Agent, or Firm* — Cislo & Thomas, LLP

(57) ABSTRACT

An exercise device having a hemispherical handle, an internal support, and a foot support for performing a variety of push-up type exercises. The hemispherical handle is designed to provide optimum support and comfort to the user. The internal support is attached to the handle in a way that permits the handle to move relative to the foot support, for example, by moving up and down, rotating, tilting from side to side, or revolving about a central axis. The foot support provides support for the handle. Pads may be removably attached to the foot support to provide the desired surface. A mat may be provided upon which the exercises may be performed.

18 Claims, 12 Drawing Sheets

TOTAL BODY EXERCISE DEVICE

TECHNICAL FIELD

This invention relates to exercise devices.

BACKGROUND

Several prior art push-up hand support devices have been developed, such as U.S. Pat. No. 7,468,025 (Hauser) and U.S. Pat. No. 7,377,888 (Godbold). These designs typically include a substantially horizontal cylindrical handle for the user to grip. There may be a bearing assembly that allows the push-up device to rotate about a vertical axis. The idea is to allow the user's hands to rotate while doing a push-up exercise, which can engage additional muscle groups during the exercise.

Comfort can be a significant drawback with these horizontal handle designs. Palm and wrist pain are common during repetitive exercise, especially during push-up exercise in certain positions. Due to the few available grip positions of the horizontal cylindrical handle, the user is left with limited ways to exercise comfortably. Furthermore, because these devices are fixed in a single location during the exercise, the versatility is limited.

For the foregoing reasons there is a need for an efficient exercise device that allows for a total upper body, core, and potentially lower body exercise while providing a comfortable grip.

SUMMARY

The present invention is directed to a comfortable, versatile, and compact exercise device that can be height adjustable, rotatable, and moveable during an exercise to increase the range of muscle groups that can be exercised. The present invention is a novel method of providing comfortable hand support for push-up exercises. The user has unlimited available hand positions for a given push-up exercise. Given the physiological variation in users, this can be a significant advantage.

The invention comprises two individual hand supports (one for each hand) that are intended to be placed on a floor or other substantially horizontal surface. The supports are adjustable in height and can provide rotation about a substantially vertical axis during exercise. In one aspect of the invention the interface with the user's hands is provided with a more ergonomic and comfortable grip. Instead of a horizontal cylindrical handle structure, the invention provides a substantially or generally hemispherical shape with a soft compliant surface for the user's hands to rest on. The hemispherical shape allows the user's hands an unlimited variety of placements for maximum comfort.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The invention of the present application provides a comfortable, lightweight, compact, exercise device that permits a wide variety of exercises to target a wide range of muscle groups, particularly muscles involved in push-up type exercises. The exercise device comprises a generally hemispherical handle assembly, an internal support structure operatively connected to the handle assembly, and a foot support operatively connected to the internal support structure to support the internal support structure and hand support assembly. The internal support structure is configured to permit the handle assembly to move relative to the foot support. For example, the handle assembly may be able to move up and down relative to the foot support, rotate about a central axis, or swivel, tilt or revolve about a central axis. Note that the shape of the handle assembly may deviate from a hemispherical profile. For example, it could be a more ergonomic shape that could be determined by ergonomic studies. The generally hemispherical shape, however, provides an omnidirectional gripping surface. The term generally hemispherical means shapes that have a spherical or sphere-like appearance, even if the shape is not a perfect half-sphere. Therefore, generally hemispherical also encompasses deviations from a perfect sphere, such as shapes that have parabolic, elliptical, or like profiles when viewed in a vertical cross-section, as shown in FIGS. 1B, 1D, 2B, 3B, 3D, and 4B.

Due to the generally hemispherical shape, the user's hand can drape over a large area. The user's fingers may curl under the lower part of the handle assembly, or extend towards the floor for certain push-up exercises.

For the sake of convenience and ease of description only, since the exercise device is designed to have the foot support placed on the floor or flat surface with the user placing his hands on the handle assembly, the direction towards the foot support from the handle assembly will be referred to as the bottom and the direction towards the handle assembly from the foot support will be referred to as the top. A neutral position will be defined as when the centers of the handle assembly, the internal support, and the foot support align with each other so as to define a central axis 10 as shown in at least FIGS. 1B, 2B, 3B, and 4B.

Figure 1B:
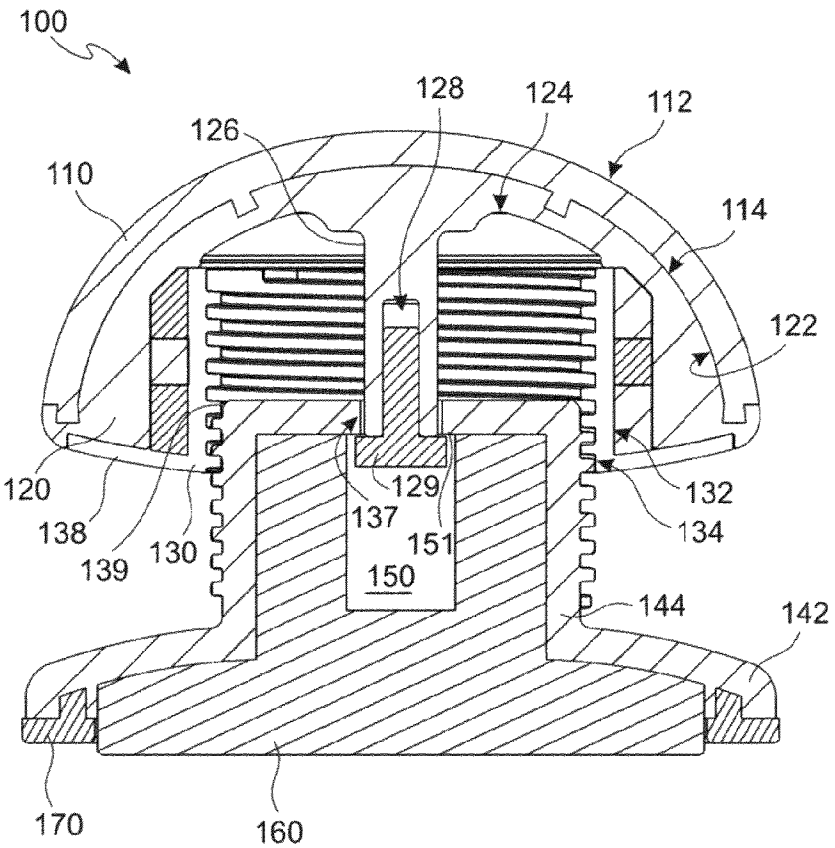
FIG. 1B shows a cross-section of the embodiment shown in FIG. 1A along line 1B-1B.
Figure 1A:
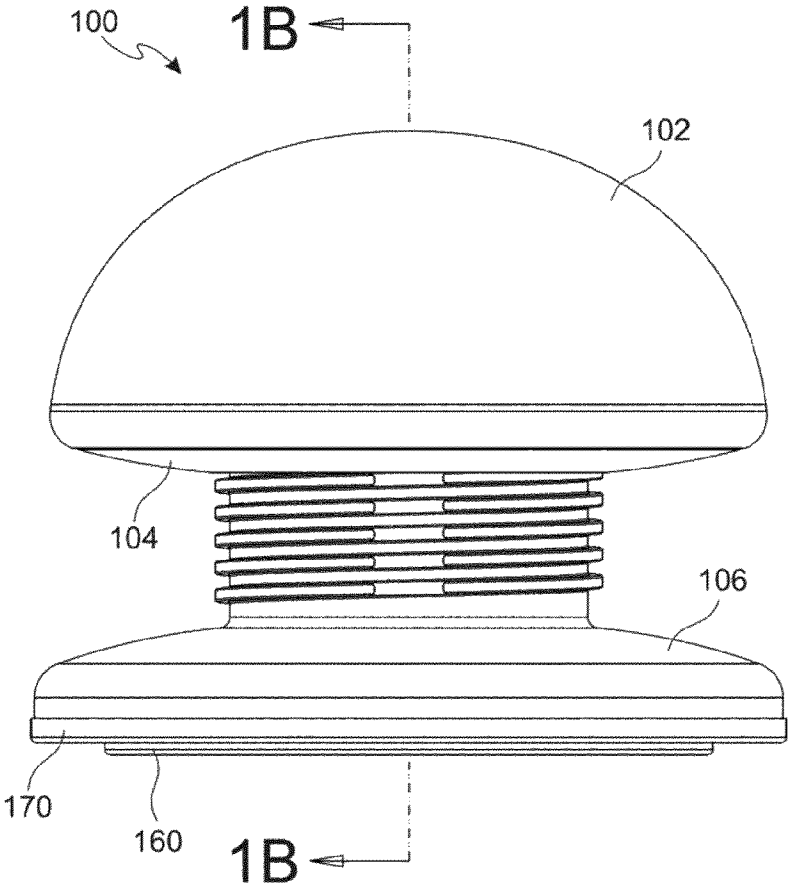
FIG. 1A shows an elevation view of an embodiment of the present invention in a first configuration.
Figure 1D:
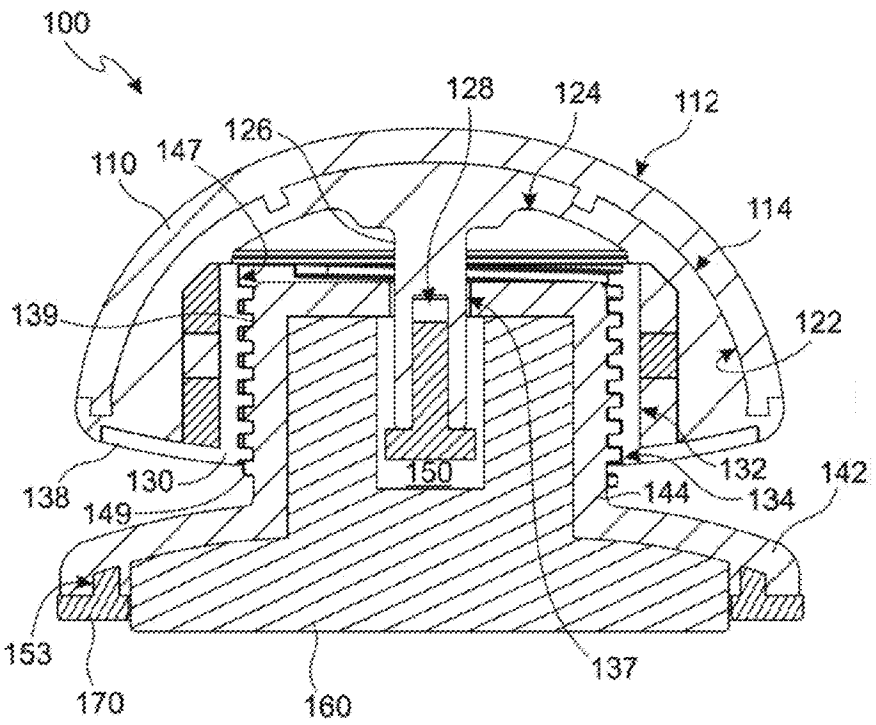
FIG. 1D shows a cross-section of the embodiment shown in FIG. 1C along line 1D-1D.
Figure 1C:
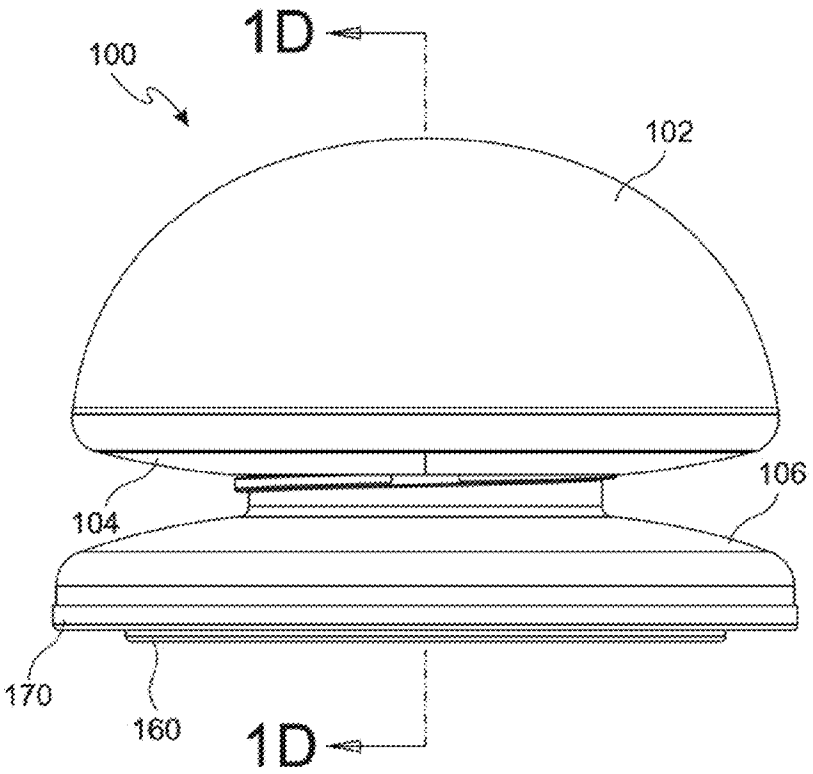
FIG. 1C shows an elevation view of the embodiment shown in FIG. 1A in a second configuration.
Figure 1E:
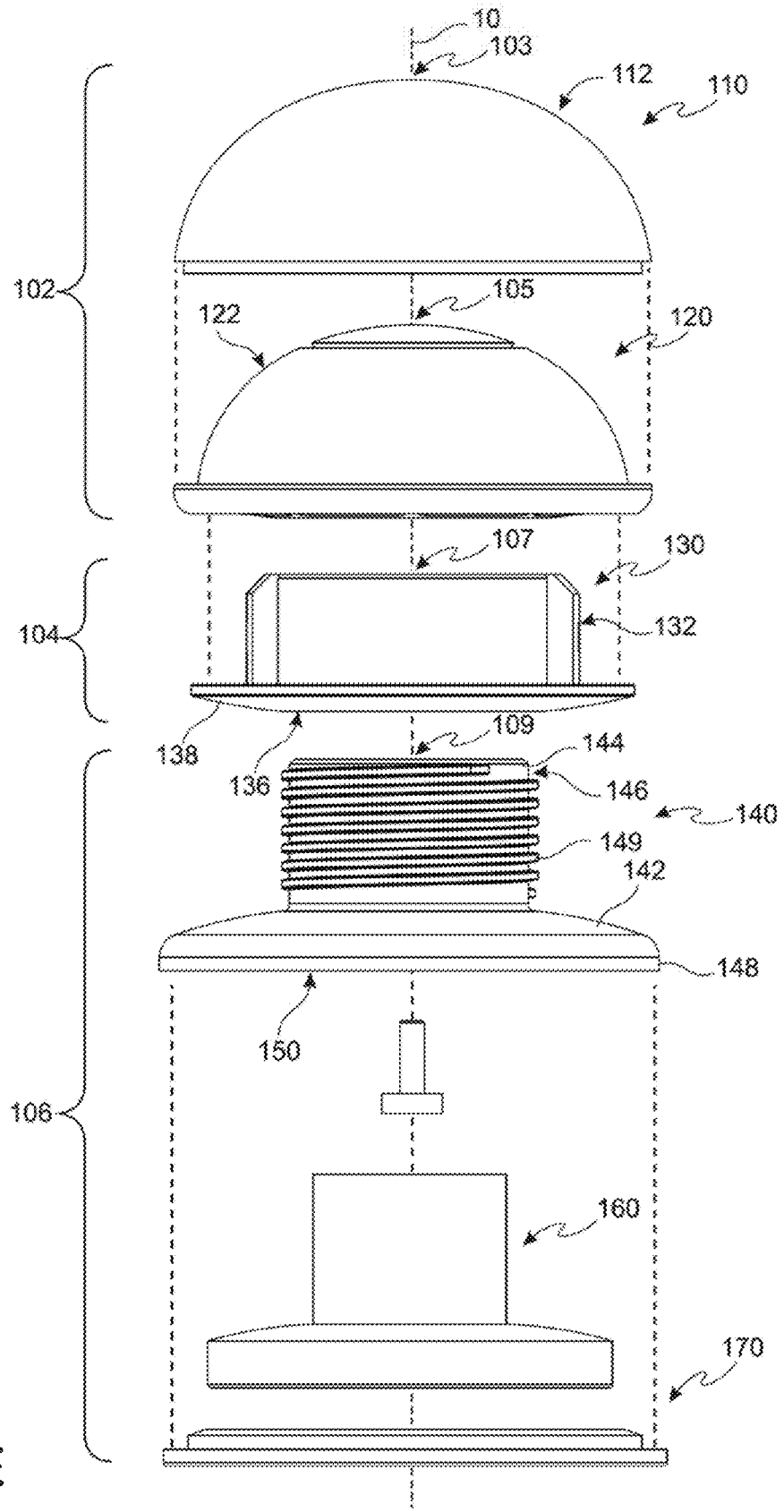
FIG. 1E shows an exploded view of the embodiment shown in FIG. 1A.

Referring now to the figures, FIGS. 1A-1E show an embodiment of the exercise device 100 comprising a handle assembly 102, an internal support 104, and a foot support 106 each have a center 103, 107, 109, respectively. When in a neutral position, the centers 103, 107, 109 of the handle assembly 102, the internal support 104, and the foot support 106, respectively, are in alignment, and the handle assembly 102, the internal support 104, and the foot support 106 are arranged concentrically with each other, thereby defining a central axis 10 through each of the centers 103, 107, 109 as shown in FIG. 1E.

The handle assembly 102 is mounted to the internal support 104 in such a way as to provide a means for allowing the handle support 102 to move relative to the foot support 106. For example, the handle assembly 102 may be capable of moving up and down relative to the foot support 106, thereby adjusting the height of the exercise device 100 (compare FIGS. 1A and 1B with FIGS. 1C and 1D, respectively). In another example, the handle assembly 102 may be capable of tilting or swiveling from side to side relative to the foot support 106. In yet another example, the handle assembly 102 may be capable of rotating or revolving about the central axis 10. Movement of the handle assembly relative to the foot support may be any combination thereof. Adjusting the height of the handle assembly 102, can adjust the difficulty of the exercise. In any embodiment, permitting rotation, swiveling, or height adjustment of the handle assembly 102 increases the complexity, and variety, of the exercises and isolates specific muscle groups.

To provide a comfortable grip, the handle assembly 102 is generally hemispherical in shape. Other push-up devices are simple rod shapes. Given the size of a typical user, rod shapes tend to dig into the palm of the hand due to the small surface area rods provide. Using a generally hemispherical shape allows the exercise device 100 to conform more closely to the entire palm of the user's hand; thereby, distributing the user's weight across a larger surface area.

To further add to the comfort, the handle assembly 102 may comprise a gripping handle 110 made of pliable cushioning material. For example, the cushioning material may be made of foam, rubber, and the like. Consistent with a hemispherical shape, the gripping handle 110 may comprise a generally convex outer surface 112. In the preferred embodiment, the gripping handle 110 may have a generally concave inner surface 114.

In the preferred embodiment, since the gripping handle 110 is pliable, the handle assembly 102 may further comprise a handle support 120 to provide a rigid support for the gripping handle 110 for mounting the gripping handle 110 to the internal support 104.

Preferably, the handle support 120 is moveably connected to the internal support 104 to permit the handle assembly 102 to move relative to the foot support 106. The handle support 120 may also comprise a generally convex outer surface 122 to mate with the generally concave inner surface 114 of the gripping handle 112. The inner surface 114 of the gripping handle 110 and the outer surface 122 of the handle support 120 may be any other shape so long as they are capable of being attached to each other. Similarly, the inner surface 124 of the handle support 120 may be any shape, but is preferably generally concave.

In some embodiments, the handle support 120 may comprise a central deviation in which the inner surface 124 of the handle support 120 deviates from its smooth normal curvature that gives the generally concave appearance. In some embodiments, the central deviation may be an abrupt downward protrusion, such as a peg or shaft 126 protruding downwardly away from the center 105 of the handle support 120 along the central axis 10 (when in the neutral position). The internal support 104 and the foot support 106 may have top openings to receive the shaft 126. Portions of the wall 137 defining the top opening of the internal support 104 and/or portions of the wall 147 defining the top opening of the foot support 106 may be parallel to and substantially the same dimensions as the shaft 126. This allows the shaft 126 to slide up and down through the openings or rotate about the central axis 10 while helping to minimize any lateral or side-to-side movement. The shaft 126 may comprise a central channel 12S into which is inserted a second peg or screw 129 having a flanged head that is wider than the shaft 126 and the top opening of the foot support 106. This prevents the handle assembly 102 from twisting off of the foot support 106 because as the shaft 126 rises up through the opening, eventually the flanged head will abut the inner wall 137 defining the top opening of the foot support 106 to prevent any further upward movement as shown in FIG. 1B.

The internal support 104 may comprise a generally cylindrical sleeve 130 operatively connected to the handle support 120, wherein the generally cylindrical sleeve 130 is defined by an outer wall 132 and an inner wall 134, wherein the inner wall 134 defines a central cavity 136. In the preferred embodiment, the inner wall 134 of the sleeve is threaded. The top and bottom of the internal support may be open to receive portions of the handle support 120 and foot support 106, respectively. In some embodiments, the bottom of the sleeve 130 may have a flanged lip 138 upon which the handle support 120 may be seated for support.

The foot support 106 comprises a foot stand 140. The foot stand 140 comprises a base 142 and a connector 144 protruding perpendicularly upwardly from the base 142. The base 142 provides a solid foundation to prevent the handle assembly 102 from tipping over while the user is performing an exercise routine. The connector 144 protruding upwardly from the base 142 connects with the sleeve 130. In the preferred embodiment, the connector 144 is cylindrical and comprises an outer wall 146. To facilitate the rotational and vertical movement of the handle assembly 102, the outer wall 146 of the connector 144 may comprise outer threads 149 so that the inner threads 139 of the sleeve 130 can be screwed onto the outer threads 149 of the connector 144. Although there is a slight vertical displacement with the rotation of the handle assembly 102, this will not affect the user during an exercise. As described above, the top of the connector 144 may have a ceiling 151 with a hole defined by the wall 137 of the ceiling 151 in the center area to receive the shaft 126 of the handle support 120. In some embodiments, the top of the connector 144 may be completely open.

Other means for vertical movement can be used, such as sliding mechanisms, rails, tracks, tongue and groove connections, and the like, with stops to stop the height adjustment at various levels.

In the preferred embodiment, the base 142 is circular in shape (circular horizontal section). A pad 170 may be affixed (by any known means, such as resistance fits, adhesion, screws, and the like) to the bottom of the base 142 to provide a desired interface between the foot support 106 and the floor. Therefore, the pad 170 may be made of material that may provide protection to the floors so that the foot support 106 does not scratch, scuff, or otherwise damage the floor. The pad 170 may provide a frictional bottom surface so that the exercise device 100 does not slip or slide during an exercise. In some embodiments, the pad 170 may provide a slick bottom surface so that the exercise device can slide along the floor. Other means for sliding along the floor may be used, such as bearings.

In the preferred embodiment, the base 142 may comprise a peripheral channel 153 into which the pad 170 can be seated. The pad 170 may be removably fastened in the channel 153 so as to be replaceable when damaged or when desiring to change the interface.

In some embodiments, the foot stand 140 defines a central void 150. This permits a pad 160 having a shape similar to the central void 150 to be inserted into the central void 150. To allow the bottom surface of the pad 160 to be used, the height of the pad 160 may be greater than the central void 150. This causes the pad 160 to protrude below the base 142 and raise the base 152 off the surface.

In some embodiments, the pad 160 may be adjustable within the central void 150 so as to adopt two configurations, wherein in a first configuration, the pad 160 protrudes out past the base 142 and the pad 160 contacts the floor, and wherein in a second configuration the pad 160 is housed completely inside the central void 150 so that the base 142 contacts the floor. For example, the pad 160 may screw or slide into the central void 150. Any other connection may be used to reversibly secure the pad 160 in the central void. In such an embodiment, the pad 160 and the base 142 may have opposite surface features so that the exercise device can adopt a sliding surface or a frictional surface. For example, in one embodiment, the base 142 may have a frictional surface while the pad 160 has a slick surface. If the user wants to conduct exercises in a fixed position, the user can either remove the pad 160 or have it inserted into the cavity 150. On the other hand, if the user wants a sliding surface, the user can insert the pad 160 or have the pad 160 protrude out past the base 142. Conversely, the base 142 may have the slick surface while the pad 160 has the frictional surface.

In some embodiments, two pads 160, 170 having opposite surface characteristics may be used. This allows the base 142 to be made of any type of rigid material, such as wood, metal, plastic, and the like, with the second pad 170 providing the dual purposes of providing a desired surface (frictional or slick) and protection against scuffing or damaging the floor with the base 142. Therefore, the user can remove the first pad 160 from the cavity 150, or move it completely into the cavity 150 to use the second pad 170 for its desired surface (frictional or slick), or insert the first pad 160 into the cavity 150, or have it descend from the cavity 150 to protrude past the second pad 170 to use the first pad 160 for its desired surface, which would be the opposite of the second pad 170.

Figure 2B:
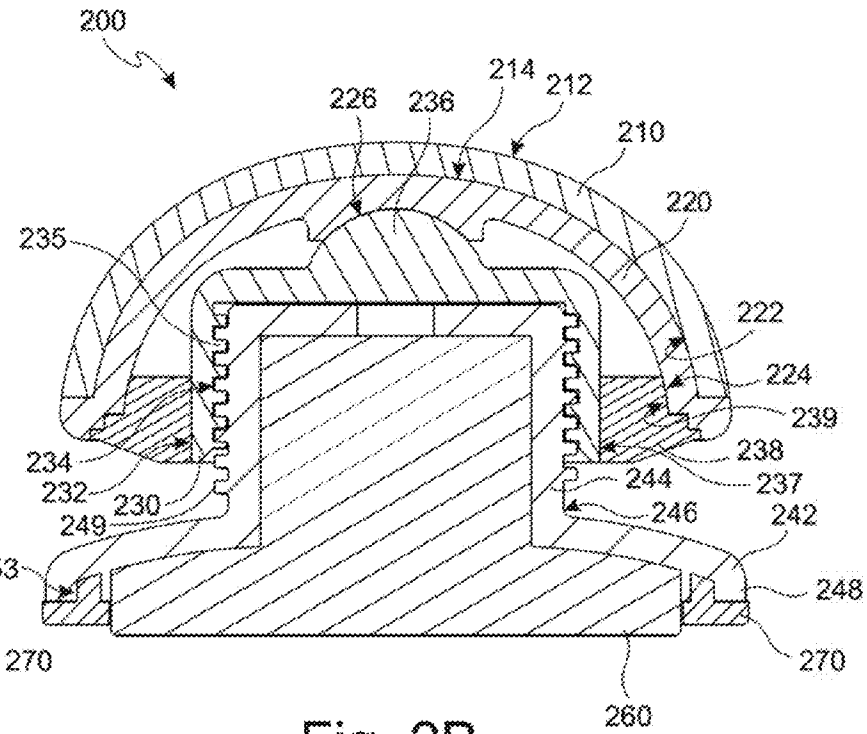
FIG. 2B shows a cross-section of the embodiment shown in FIG. 2A along line 2B-2B.
Figure 2A:
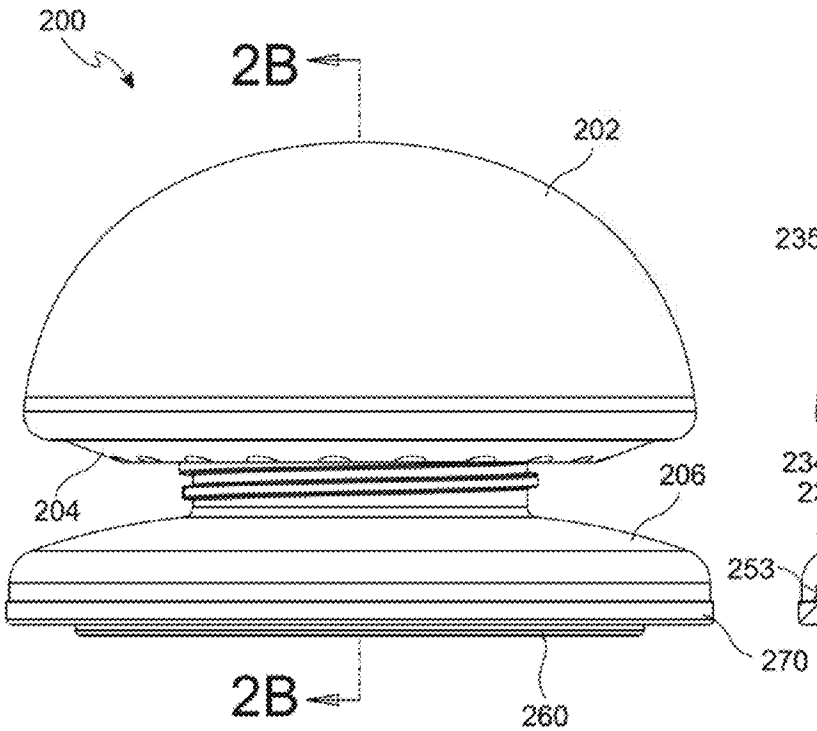
FIG. 2A shows an elevation view of another embodiment of the present invention.
Figure 2C:
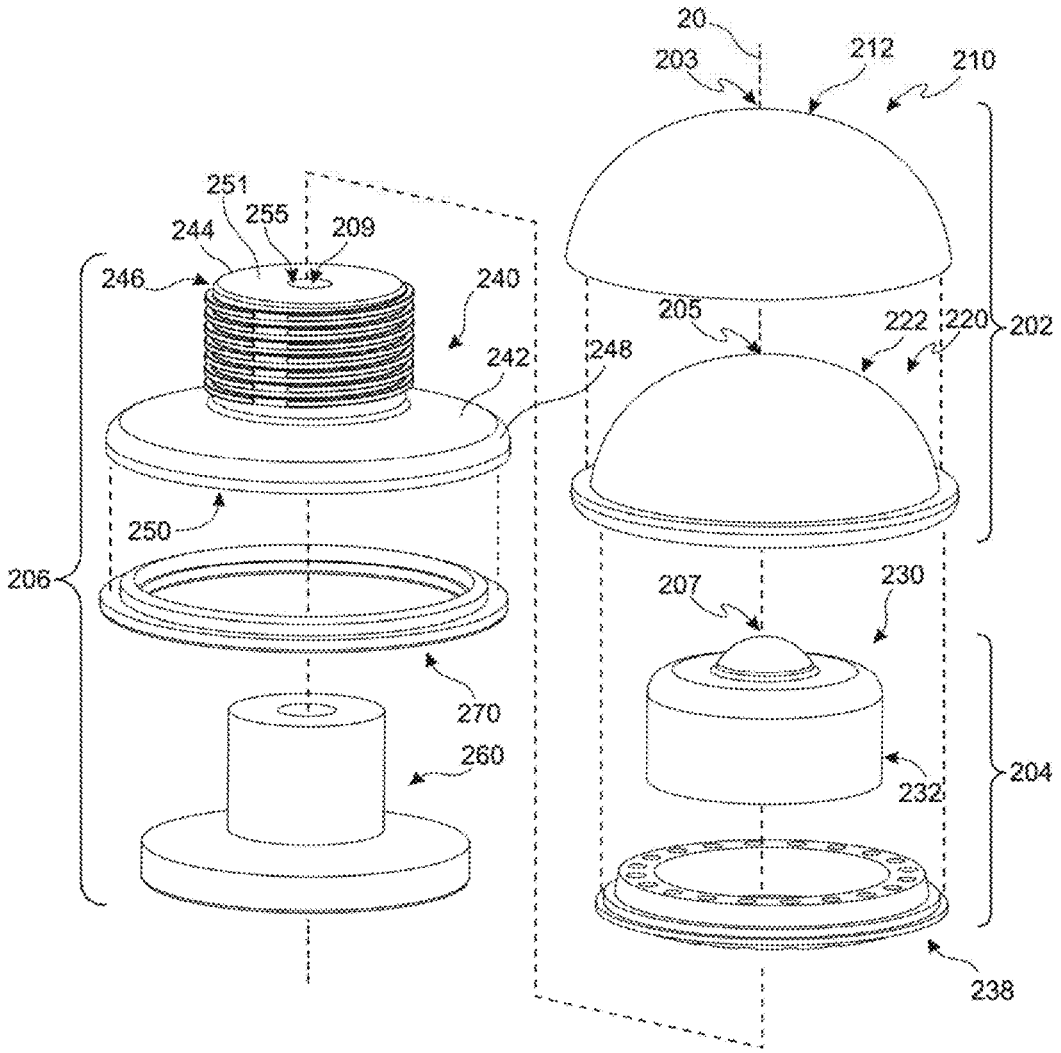
FIG. 2C shows an exploded view of the embodiment shown in FIG. 2A.

In the embodiment shown in FIGS. 2A-2C, the exercise device 200 comprises very similar parts as the embodiment described above, except for modifications that permit the handle assembly 202 to rotate, swivel, tilt, or revolve about the central axis 20. Like the embodiment described above, the exercise device 200 comprises a generally hemispherical handle assembly 200 having a center 203, an internal support structure 204 operatively connected to the handle assembly 202, and a foot support 206 operatively connected to the internal support 204 to support the internal support structure 204 and handle assembly 202. The internal support 204 is configured to permit the handle assembly 202 to move relative to the foot support 206.

In the preferred embodiment, the handle assembly 202, the internal support 204 and the foot support 206 each have a center. When in a neutral position, the centers 203, 207, 209 of the handle assembly 202, the internal support 204, and the foot support 206, respectively, are aligned, and the handle assembly 202, the internal support 204, and the foot support 206 are arranged concentrically with each other, thereby defining the central axis 20 through each of the centers.

The handle assembly 202 is mounted to the internal support 204 in such a way as to provide a means for allowing the handle assembly 202 to move relative to the foot support 206. For example, like the embodiment shown in FIGS. 1A-1E, the handle assembly 202 may be capable of moving up and down relative to the foot support 206, thereby adjusting the height of the exercise device 200. In another example, the handle assembly 202 may be capable of tilting or swiveling from side to side relative to the foot support 206. In yet another example, the handle assembly 202 may be capable of rotating about the central axis 20. Movement of the handle assembly 202 relative to the foot support 206 may be any combination thereof.

To provide a comfortable grip, the handle assembly 202 is generally hemispherical in shape. To further add to the comfort, the handle assembly 202 may comprise a gripping handle 210 made of pliable cushioning material. For example, the cushioning material may be made of foam, rubber, and the like. Consistent with a hemispherical shape, the gripping handle 210 may comprise a generally convex outer surface 212. In the preferred embodiment, the gripping handle 210 may have a generally concave inner surface 214.

Since the gripping handle 210 is pliable, the handle assembly 202 may further comprise a handle support 220 to provide a rigid support for the gripping handle 210 for mounting the gripping handle 210 to the internal support 204. Preferably, the handle support 220 is moveably connected to the internal support 204 to permit the handle assembly 202 to move relative to the foot support 206.

The handle support 220 may also comprise a generally convex outer surface 222 to mate with the generally concave inner surface 214 of the gripping handle 210. The inner surface 214 of the gripping handle 210 and the outer surface 222 of the handle support 220 may be any other shape so long as they are capable of being attached to each other. Similarly, the inner surface 224 of the handle support 220 may be any shape, but is preferably generally concave.

In the preferred embodiment, the handle support 220 is moveably connected to the internal support 204. For example, the connection between the handle support 220 and the internal support 204 may permit swiveling, tilting, revolving, or rotating of the handle support 220 relative to the foot support 206 or the internal support 204 (or the central axis 20) by the use of a ball and socket joint 226, 236. In some embodiments, the connection between the handle support 220 and the internal support 204 may permit the handle support 220 to move longitudinally along the central axis 20 away from the internal support 204 or the foot support 206 with the use of threaded connections, tongue and groove connections, rails, tracks and the like, with stops to stop secure the handle assembly 202 at various heights. In other embodiments, vertical movement is achieved through the connection between the internal support 204 and the foot support 206.

In some embodiments, the handle support 220 may comprise a central deviation in which the inner surface 224 of the handle support 220 deviates from its smooth normal curvature that gives the generally concave appearance. In the preferred embodiment, the central deviation is a socket 226.

The internal support comprises a sleeve 230, preferably cylindrical in shape, operatively connected to the handle support 220, wherein the sleeve 230 is defined by an outer wall 232 and an inner wall 234, wherein the inner wall 234 defines a central cavity. In the preferred embodiment, the inner wall 234 of the sleeve 230 is threaded 235. The bottom of the sleeve 230 may be open to receive portions of the foot support 206.

The top of the internal support 204 may comprise an apical ball 236 or upward protrusion configured to mate with the socket 226 to form a ball and socket joint. This connection allows the handle support 220 to rotate or spin, swivel, and tilt about the ball 236.

The exercise device 200 may further comprise a resilient compliance ring 238 having an inner surface 237 and an outer surface 239, wherein the inner surface 237 of the compliance ring 238 is configured to mount on the sleeve 230, and wherein the outer surface 239 of the compliance ring 238 is configured to abut against the generally concave inner surface 224 of the handle support 220. The compliance ring 238 forces the handle assembly 202 to return to the neutral position when a force is removed from the handle assembly 202.

Figure 3B:
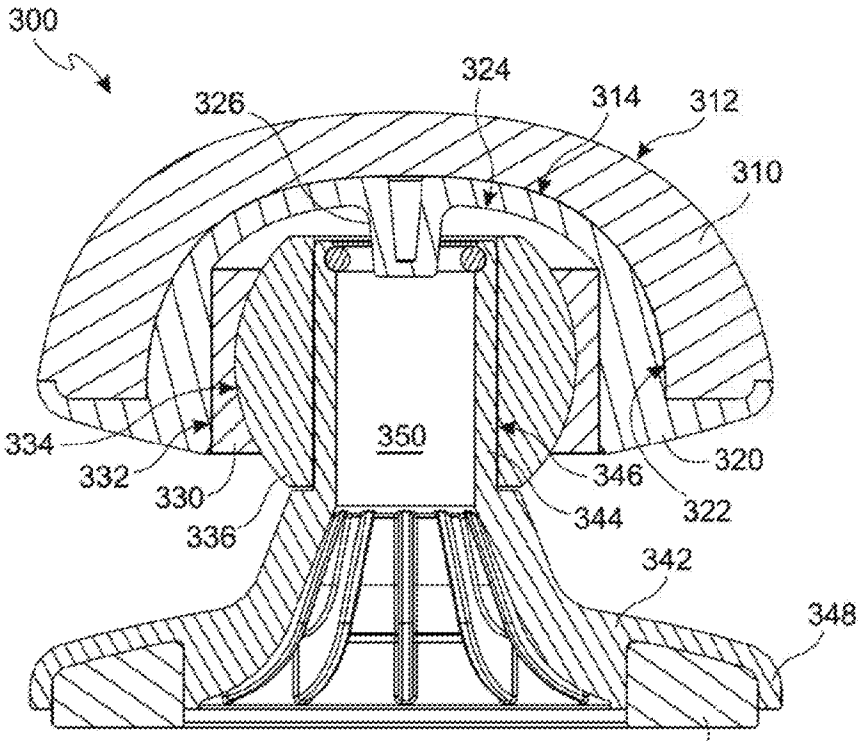
FIG. 3B shows a cross-section of the embodiment shown in FIG. 3A along line 3B-3B.
Figure 3A:
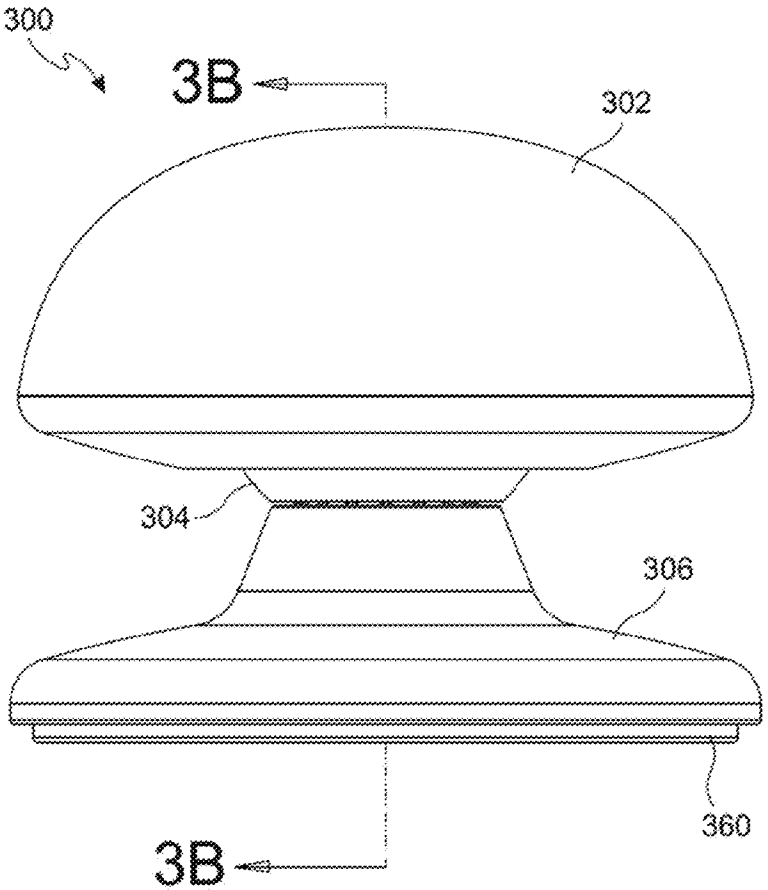
FIG. 3A shows an elevation view of another embodiment of the present invention.
Figure 3D:
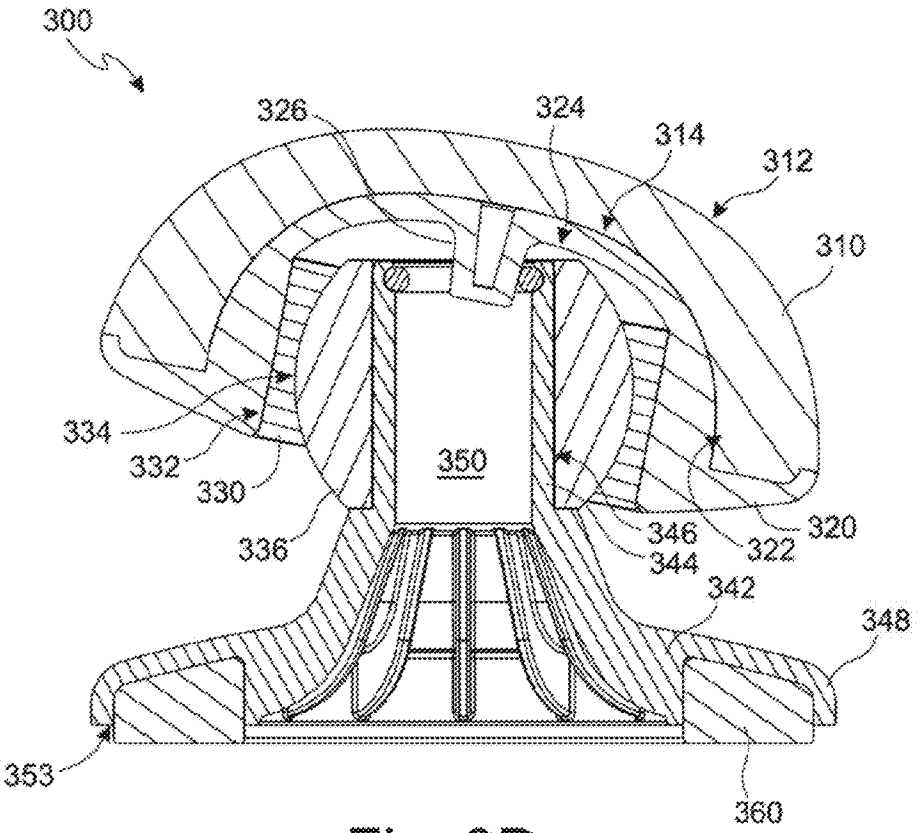
FIG. 3D is a cross-section of the embodiment shown in FIG. 3C along line 3D-3D.
Figure 3C:
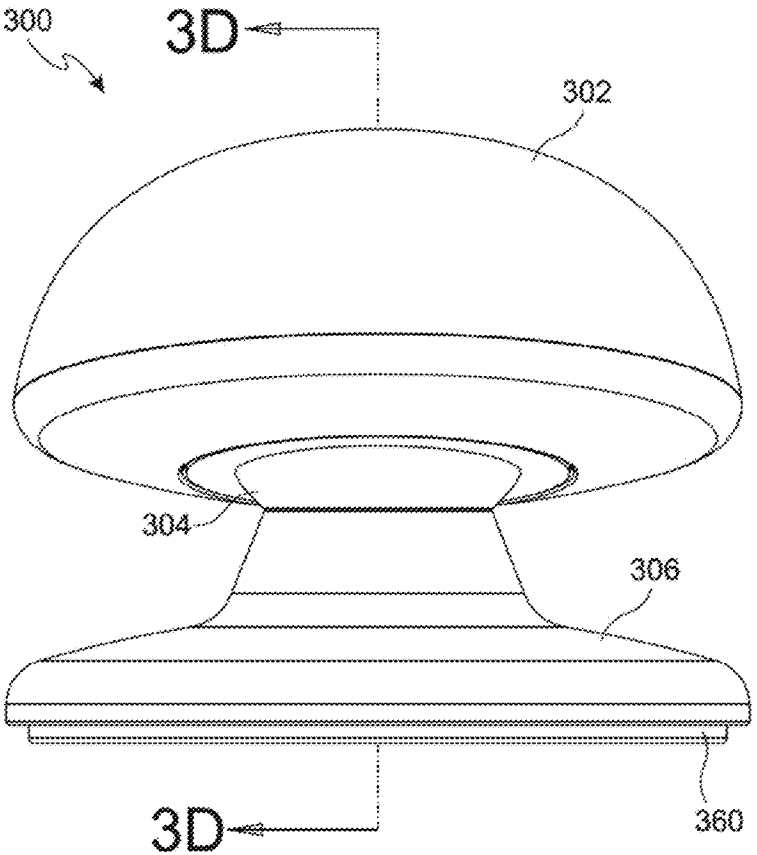
FIG. 3C shows the embodiment in FIG. 3A in a tilted configuration.
Figure 3E:
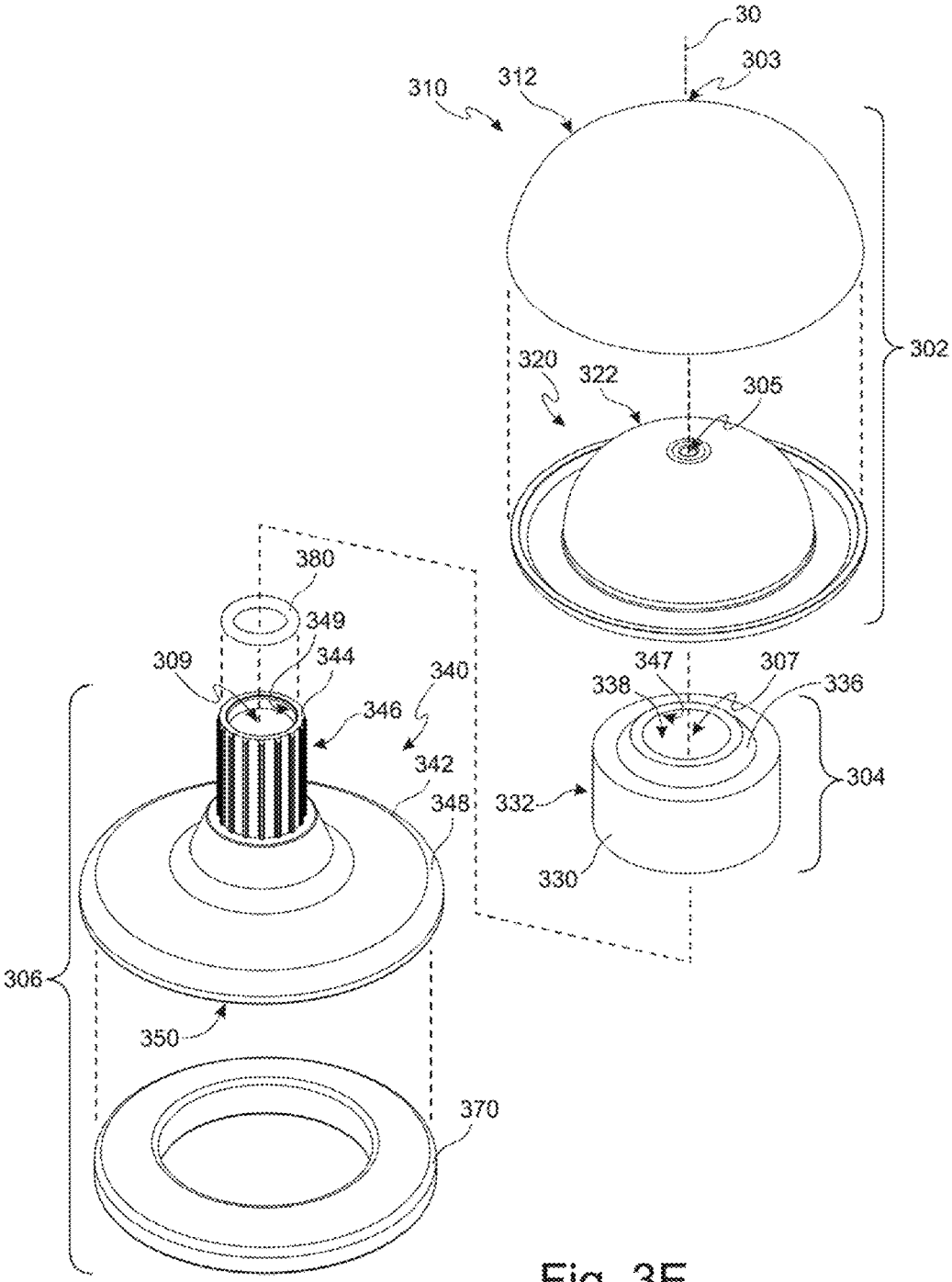
FIG. 3E shows an exploded view of the embodiment shown in FIG. 3A.

For example, a user may place his hands on the handle assembly 202 and shift his weight so as to cause the center 203 handle assembly 202 to tilt off the center axis 20 similar to what is shown in FIG. 3D. Due to the compressible nature of the compliance ring 238, the handle assembly 202 is able to compress the compliance ring 238 and tilt. If the user releases the handle assembly 202, the compliance ring returns to its natural shape and forces the handle assembly 202 back to its neutral position. This same action also facilitates the user bringing the handle assembly 202 back to the neutral position in the middle of the exercise.

The compliance ring 238 also permits the handle assembly 202 to rotate about the foot support 206 due to the connection to the internal support 204 so that the handle assembly 202 can be raised or lowered due to the threaded connection between the internal support 204 and the foot support 206. Rotation of the internal support 204 allows the internal support 204 to rise and lower along the threading 249 on the foot support 206. Other means for vertical movement can be used, such as sliding mechanisms, rails, tracks, tongue and groove connections, and the like, with stops to secure the handle assembly 202 at various heights.

Like the embodiment in FIGS. 1A-1E, the foot support 206 comprises a foot stand 240 having base 242 and a connector 244 protruding perpendicularly upwardly from the base 242. The base 242 provides a solid foundation to prevent the handle assembly 202 from tipping over while the user is performing an exercise routine. The connector 244 protruding upwardly from the base 242 connects with the internal support 204. In the preferred embodiment, the connector 244 is cylindrical and comprises an outer wall 246. To facilitate the rotational and vertical movement of the handle assembly 202, the outer wall 246 of the connector 244 may comprise outer threads 249 so that the inner threads 235 of the sleeve 230 can be screwed onto the outer threads 249 of the connector 244. Although there is a slight vertical displacement with the rotation of the hand support assembly, this will not affect the user during an exercise. Like the embodiments in FIGS. 1A-1E, the top of the connector 244 may have a ceiling 251 with a hole 255 in the center area 209 to receive a shaft with a flanged head from the handle support 220 or the sleeve 230 to serve as a stop. In some embodiments, the top of the connector 244 may be completely open.

In the preferred embodiment, the base 242 is circular in shape (circular horizontal section). A pad 270 may be affixed (by any known means, such as resistance fits, adhesion, screws, and the like) to the bottom of the base 242 to provide a desired interface between the foot support 206 and the floor. Therefore, the pad 270 may be made of material that may provide protection to the floors so that the foot support 206 does not scratch, scuff, or otherwise damage the floor. The pad 270 may provide a frictional surface so that the exercise device 200 does not slip or slide during an exercise. In some embodiments, the pad 270 may provide a slick surface so that the exercise device can slide along the floor.

In the preferred embodiment, the base 242 may comprise a peripheral channel 253 into which the pad can be seated. The pad 270 may be removably fastened in the channel 253 so as to be replaceable when damaged or when desiring to change the interface.

In some embodiments, the foot stand 240 defines a central void 250. This permits a pad 260 having a shape similar to the central void 250 to be inserted into the central void 250. To allow the surface of the pad 260 to be used, the height of the pad 260 may be greater than the central void 250. This causes the pad 260 to protrude below the base 242 and raise the base 242 off the floor.

In some embodiments, the pad 260 may be adjustable within the central void 250 so as to adopt two configurations, wherein in a first configuration, the pad 260 protrudes out past the base 242 and the pad 260 contacts the floor, and wherein in a second configuration the pad 260 is housed completely inside the central void 250 so that the base 242 contacts the floor. For example, the pad 160 may screw or slide into the central void 150. Any other connection may be used to reversibly secure the pad 160 in the central void. In such an embodiment, the pad 260 and the base 242 may have opposite surface features so that the exercise device can adopt a sliding surface or a frictional surface depending on which is touching the floor. For example, in one embodiment the base 242 may have a frictional surface while the pad 260 has a slick surface. If the user wants to conduct exercises in a fixed position, the user can either remove the pad 260 or have it inserted into the cavity 250. On the other hand, if the user wants a sliding surface, the user can insert the pad 260 or have the pad 260 protrude past the base 242, for example, with the use of threads. Conversely, the base 242 may have the slick surface while the pad 260 has the frictional surface.

In some embodiments, the base 242 may comprise a peripheral channel 253 into which a second pad 270 having opposite features compared to the first pad 260 can be inserted. This allows the base to made of any type of rigid material with the second pad 270 providing the dual purposes of providing a desired surface (frictional or slick) and protection against scuffing or damaging the floor by the base 242. Therefore, the user can remove the first pad 260 from the cavity 250, or move it completely into the cavity 250 to use the second pad 270 for its desired surface (frictional or slick), or insert the first pad 260 into the cavity, or have it descend from the cavity 250 to protrude past the second pad 270 to use the first pad 260 for its desired surface, which would be the opposite of the second pad 270.

The embodiment shown in FIGS. 3A-3E show another means to allow an exercise device to swivel about a foot support. The exercise device 300 comprises similar parts as the embodiments described above, except as described herein, particularly for modifications that permit the handle assembly 302 to not only rotate, but also swivel, tilt, or revolve about a central axis 30. Like the embodiments described above, the exercise device 300 comprises a generally hemispherical handle assembly 302 having a center, an internal support structure 304 operatively connected to the handle assembly 302, and a foot support 306 operatively connected to the internal support structure 304 to support the internal support 304 and handle assembly 302. The internal support 304 is configured to permit the handle assembly 302 to move relative to the foot support 306. For example, the handle assembly 302 may be able to move up and down relative to the foot support 306, rotate about the central axis 30, or swivel, tilt or revolve about the central axis 30.

In the preferred embodiment, the handle assembly 302, the internal support 304 and the foot support 306 each have a center 303, 307, 309, respectively. When in a neutral position, the centers 303, 307, 309 of the handle assembly 302, the internal support 304, and the foot support 306 are aligned, and the handle assembly 302, the internal support 304, and the foot support 306 are arranged concentrically with each other, thereby defining a central axis 30 through each of the centers 303, 307, 309.

The handle assembly 302 is mounted to the internal support 304 in such a way as to provide a means for allowing the handle support to move relative to the foot support 306. For example, like the previous embodiments, the handle assembly 302 may be capable of moving up and down relative to the foot support 306, thereby adjusting the height of the exercise device 300. In another example, the handle assembly 302 may be capable of tilting or swiveling from side to side relative to the foot support 306. In yet another example, the handle assembly 302 may be capable of rotating about the central axis 30. Movement of the handle assembly 302 relative to the foot support 306 may be any combination thereof.

To provide a comfortable grip, the handle assembly 302 is generally hemispherical in shape. To further add to the comfort, the handle assembly 302 may comprise a gripping handle 310 made of pliable cushioning material. For example, the cushioning material may be made of foam, rubber, and the like. Consistent with a hemispherical shape, the gripping handle 310 may comprise a generally convex outer surface 312. In the preferred embodiment, the gripping handle 310 may have a generally concave inner surface 314.

In the preferred embodiment, since the gripping handle 310 is pliable, the handle assembly 302 may further comprise a handle support 320 to provide a rigid support for the gripping handle 310 for mounting the gripping handle 310 to the internal support 304. Preferably, the handle support 320 is moveably connected to the internal support 304 to permit the handle assembly 302 to move relative to the foot support 306.

The handle support 320 may also comprise a generally convex outer surface 322 to mate with the generally concave inner surface 314 of the gripping handle 310. The inner surface 314 of the gripping handle 310 and the outer surface 322 of the handle support 320 may be any other shape so long as they are capable of being attached to each other. Similarly, the inner surface 324 of the handle support 320 may be any shape, but is preferably generally concave.

In the preferred embodiment, the handle support 320 is moveably connected to the internal support 304. For example, the connection between the handle support 320 and the internal support 304 may permit swiveling, tilting, revolving, or rotating of the handle support 320 relative to the foot support 306 or the internal support 304 (or the central axis 30) by the use of a ball and socket joint 330, 336. The connection between the handle support 320 and the internal support 304 may permit the handle support to move longitudinally along the central axis 30 away from the internal support 304 or the foot support 206 with the use of threaded connections, tongue and groove connections, rails, tracks, and the like, similar to previous embodiments.

In some embodiments, the handle support 320 may comprise a central deviation in which the inner surface of the handle support 320 deviates from its smooth normal curvature that gives the generally concave appearance. In some embodiments, the central deviation may be an abrupt downward protrusion, such as a peg or shaft 326 protruding downwardly away from the center 305 of the handle support 320 along the central axis 30 (when in the neutral position). The internal support 304 and the foot support 306 may have an opening to receive the shaft 326 to restrict the tilting action of the handle assembly 302 as described below.

The internal support 304 comprises a sleeve 330 that is preferably cylindrical in shape and operatively connected to the handle support 320. The sleeve 330 is defined by an outer wall 332 and an inner wall 334, wherein the inner wall 334 defines a central cavity 338. In the preferred embodiment, the inner wall 334 of the sleeve 330 is generally concave in shape. The top and bottom of the sleeve 330 may be open.

The internal support 304 further comprises a spherical bearing 336 having a convex curvature substantially similar to the concave curvature of the sleeve 330 so that the sleeve 330 can be mounted about the spherical bearing 336 to provide tilting and rotational movement of the handle assembly 302 about the foot support 306. The spherical bearing 336 is fixedly mounted on the foot support 306. For example, the spherical bearing 336 may have a central cavity with which the spherical bearing 336 can be mounted on the foot support 306.

Like the previous embodiments, the foot support 306 comprises a foot stand 340 having a base 342 and a connector 344 protruding perpendicularly upwardly from the base 342. The base 342 provides a solid foundation to prevent the handle assembly 302 from tipping over while the user is performing an exercise routine. The connector 344 protruding upwardly from the base 342 connects with the internal support 304. Preferably, the connector 344 connects with the spherical bearing 336. In the preferred embodiment, the connector 344 is cylindrical and comprises an outer wall 346. The dimensions of the outer wall 346 may be substantially similar to the dimensions of the inner wall 347 of the spherical ball 336 so that the spherical ball 336 can be mounted on the connector 344. In some embodiments, the outer wall 346 may be corrugated and the inner wall 347 of the spherical ball 336 defining the central cavity may have corrugations as well to fit with the connector 344 in a manner that prevents the spherical ball 336 from rotating about the connector 344.

The top of the connector 344 may be open to receive the shaft 326 of the handle support 320. The shaft 326 may restrict the tilting action of the handle support 320 by abutting against the inner wall 349 of the connector 344 when displaced from the neutral position. In some embodiments, an O-ring 380 may be placed inside the inner wall 349 of the connector 344 to provide cushioning for the shaft 326 as it abuts against the inner wall 347 of the connector 344.

In the preferred embodiment, the base 342 is circular in shape (circular horizontal section). A pad 370 may be affixed (by any known means, such as resistance fits, adhesion, screws, and the like) to the bottom of the base 342 to provide a desired interface between the foot support 306 and the floor. Therefore, the pad 370 may be made of material that may provide protection to the floors so that the foot support 306 does not scratch the floor. The pad 370 may provide a frictional surface so that the exercise device 300 does not slip or slide during an exercise. In this embodiment, although a pad 370 with a slick surface can be used, it is not preferable as the combination of the tilting and swiveling could prove to be difficult with sliding action. However, it is conceivable that highly advanced users could perform such an exercise.

Therefore, like the previous embodiments, the base 342 may comprise a peripheral channel 353 into which the pad 370 can be seated. The pad 370 may be removably fastened in the channel 353 so as to be replaceable when damaged or when desiring to change the interface with the floor.

In some embodiments, the foot stand 340 defines a central void 350 accessible through an open bottom of the base 342. This permits a pad (not shown, but like 160 and 260) having a shape similar to the central void 350 to be inserted into the central void 350. To allow the surface of the pad to be used, the height of the pad may be greater than the central void 350. This causes the pad to protrude below the opening of the base 342 and raise the base off the floor.

In some embodiments, the pad may be adjustable within the central void 350 so as to adopt two configurations, wherein in a first configuration, the pad protrudes out past the base 342 and the pad contacts the floor, and wherein in a second configuration the pad is housed completely inside the central void 350 so that the base 342 contacts the floor. For example, the pad may screw or slide into the central void 350. Any other connection may be used to reversibly secure the pad in the central void 350. In such an embodiment, the pad and the base 342 may have opposite surface features so that the exercise device 300 can adopt a sliding surface or a frictional surface. For example, in one embodiment the base 342 may have a frictional surface while the pad has a slick surface. If the user wants to conduct exercises in a fixed position, the user can either remove the pad or have it inserted into the cavity 350. On the other hand, if the user wants a sliding surface, the user can insert the pad or have the pad protrude out from the base 342. Conversely, the base 342 may have the slick surface while the pad has the frictional surface.

In some embodiments, the base 342 may comprise a peripheral channel 353 into which a second pad 370, having opposite features compared to the first pad, can be inserted. This allows the base 342 to made of any type of rigid material with the second pad 370 providing the dual purposes of providing a desired surface (frictional or slick) and protection against scuffing or damaging the floor by the base 342. Therefore, like the previous embodiments, the user can toggle between a first pad and a second pad, wherein the two pads have different surface characteristics.

Figure 4B:
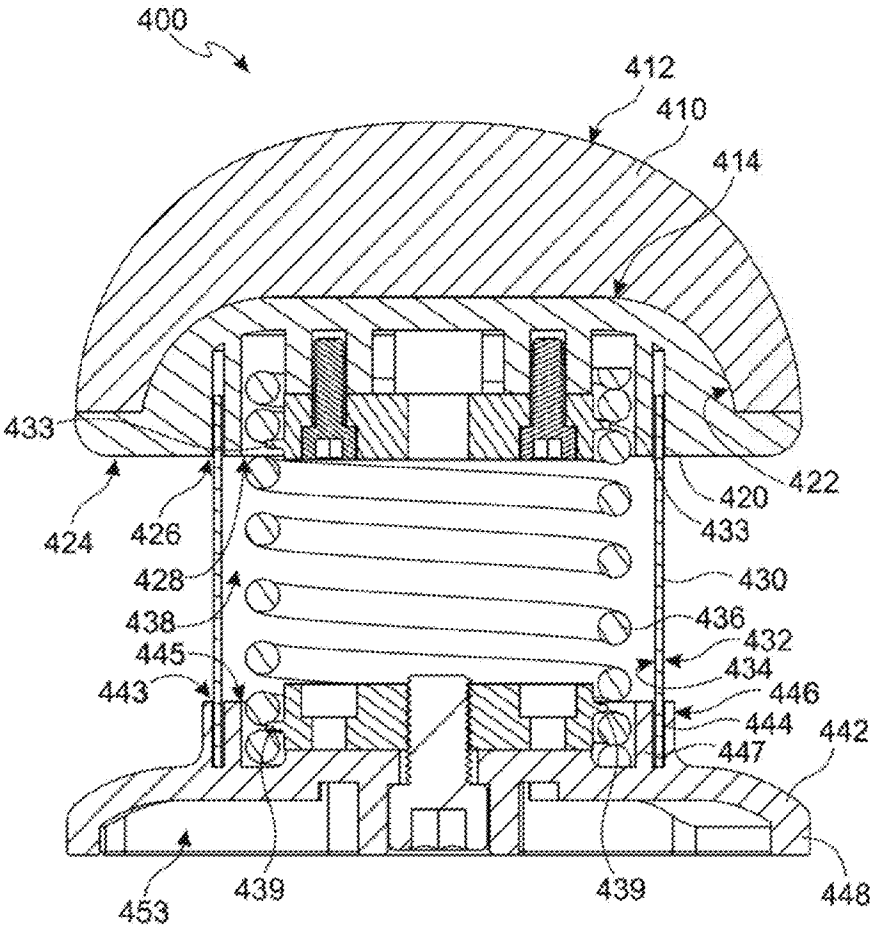
FIG. 4B shows a cross-section of the embodiment shown in FIG. 4A along line 4B-4B.
Figure 4A:
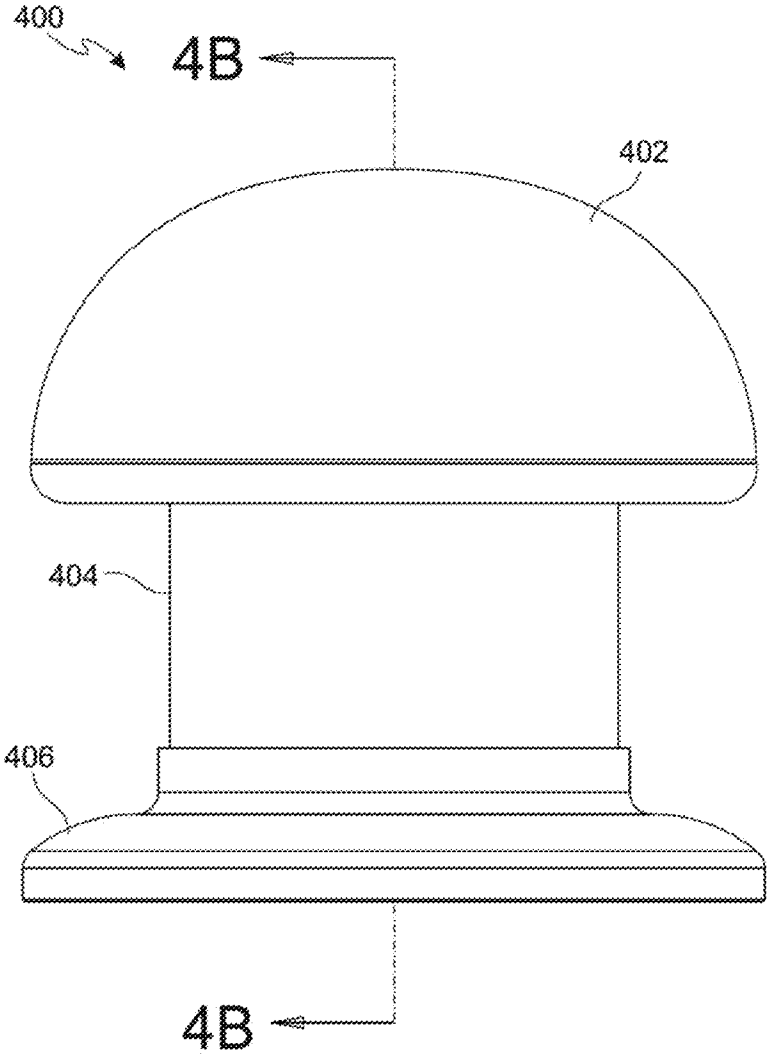
FIG. 4A shows an elevation view of another embodiment of the present invention.
Figure 4C:
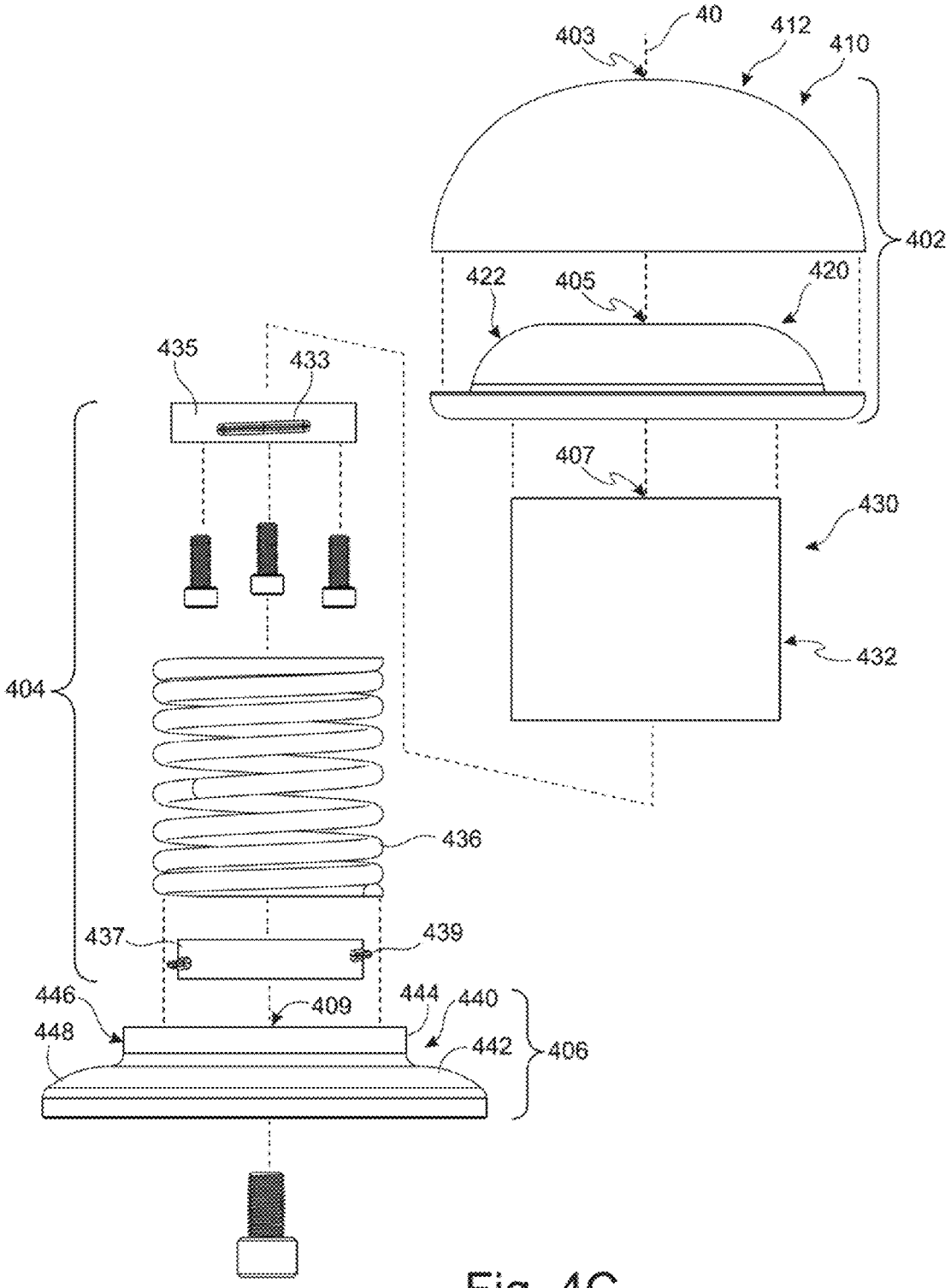
FIG. 4C shows an exploded view of the embodiment shown in FIG. 4A.

The embodiment shown in FIGS. 4A-4C shows yet another means for allowing tilting and swiveling action of the handle assembly. Like the previous embodiments, the exercise device 400 comprises a generally hemispherical handle assembly 402 having a center 403, an internal support structure 404 operatively connected to the handle assembly 402, and a foot support 406 operatively connected to the internal support 404 to support the internal support 404 and handle support assembly 402. The internal support 404 is configured to permit the handle assembly 402 to move relative to the foot support 406. For example, the handle assembly 402 may be able to move up and down relative to the foot support 406, rotate about a central axis 40, or swivel, tilt or revolve about the central axis 40.

In the preferred embodiment, the handle assembly 402, the internal support 404 and the foot support 406 each have a center 403, 407, 409, respectively. When in a neutral position, the centers 403, 407, 409 of the handle assembly 402, the internal support 404, and the foot support 406 are aligned, and the handle assembly 402, the internal support 404, and the foot support 406 are arranged concentrically with each other, thereby defining the central axis 40 through each of the centers.

The handle assembly 402 is mounted to the internal support 404 in such a way as to provide a means for allowing the handle assembly 402 to move relative to the foot support 406. For example, the handle assembly 402 may be capable of tilting or swiveling from side to side relative to the foot support 406. In yet another example, the handle assembly 402 may be capable of rotating about or revolving about the central axis 40. Movement of the handle assembly 402 relative to the foot support 406 may be any combination thereof.

To provide a comfortable grip, the handle assembly 402 is generally hemispherical in shape. To further add to the comfort, the handle assembly 402 may comprise a gripping handle 410 made of pliable cushioning material. For example, the cushioning material may be made of foam, rubber, and the like. Consistent with a hemispherical shape, the gripping handle 410 may comprise a generally convex outer surface 412. In the preferred embodiment, the gripping handle 410 may have a generally concave inner surface 414.

In the preferred embodiment, since the gripping handle 410 is pliable, the handle assembly 402 may further comprise a handle support 420 to provide a rigid support for the gripping handle 410 for mounting on to the internal support 404. The handle support 420 may also comprise a generally convex outer surface 422 to mate with the generally concave inner surface 414 of the gripping handle 410. The inner surface 414 of the gripping handle 410 and the outer surface 422 of the handle support 420 may be any other shape so long as they are capable of being attached to each other.

The inner surface 424 of the handle support 420 is configured with channels 426, 428 and holes 429 for receiving and securing the internal support 404. In the preferred embodiment, the inner surface 424 comprises an outer channel 426 and an inner channel 428. More preferably, the channels 426, 428 are in the form of a ring. The inner channel 428 and the outer channel 426 may be concentrically arranged. The foot support 406 may have similar outer 443 and inner 445 channels formed into its top surface opposite, but facing the handle support 420.

The internal support 404 comprises a generally cylindrical sleeve 430 operatively connected to the handle support 420, wherein the generally cylindrical sleeve is defined by an outer wall 432 and an inner wall 434, wherein the inner wall 434 defines a central cavity 438. The top and bottom of the sleeve 430 may be open to allow the top portion of the sleeve 430 to be seated in the outer channel 426 of the handle support 420 and the lower portion of the sleeve 430 to be seated in the outer channel 443 of the foot support 406. The sleeve 430 can be made with any flexible material so as not to hinder the tilting or swiveling actions of the handle assembly 402.

The internal support 404 may further comprise a coil spring 436. The ends of the coil spring 436 may be seated inside the inner channel 428 of the handle support 420 and the inner channel 445 of the foot support 406. Since the inner and outer channels 426, 428 are concentrically arranged, this permits the sleeve 430 to surround the coil spring 436 to cover the coil spring 436. Spring clamps 435, 437 may be fastened to the handle support 420 and the foot support 406 to clamp the coil spring 436 in place. Flanged lips 433, 439 protruding from the outer wall of the spring clamps 435, 437 can be inserted in the space in between turns of the coil spring 436 to secure the coil spring 436 to the spring clamps 435, 437.

Due to the characteristics of a coil spring 436, the handle assembly 402 will be permitted to be displaced from the central axis 40. When displaced from the central axis 40, the coil spring 436 exerts a biasing force back towards the neutral position thereby assisting the user to bring the handle assembly 402 back to the neutral position. Due to the characteristics of a coil spring 436, the handle assembly 402 can be displaced in any direction. The extent of the displacement will depend on the coil spring 436. The sleeve 430 may be flexible to flex with the displacement of the coil spring 436.

The foot support 406 comprises foot stand 440 having a base 442 and a connector 444 protruding perpendicularly upwardly from the base 442. The base 442 provides a solid foundation to prevent the handle assembly 402 from tipping over while the user is performing an exercise routine. The connector 444 protruding upwardly from the base 442 connects with the internal support structure 404. In the preferred embodiment, the connector 444 is cylindrical and comprises an outer wall 446 and an inner wall 447 to define the outer channel 443 into which the sleeve 430 can be inserted at the bottom end.

In the preferred embodiment, the base 442 is circular in shape (circular horizontal section). Like the previous embodiments, a pad may be affixed (by any known means, such as resistance fits, adhesion, screws, and the like) to the bottom of the base 442 to provide a desired interface between the foot support 406 and the floor. Therefore, the pad may be made of material that may provide protection to the floors so that the foot support 406 does not scratch the floor. The pad may provide a frictional surface so that the exercise device 400 does not slip or slide during an exercise. In this embodiment, although a pad with a slick surface can be used, it is not preferable as the combination of the tilting and swiveling could prove to be difficult with sliding action. However, it is conceivable that highly advanced users could perform such an exercise.

In the preferred embodiment, the base 442 may comprise a peripheral channel 453 into which the pad can be seated. The pad may be removably fastened in the channel 453 so as to be replaceable when damaged or when desiring to change the interface, as well as providing protection against scuffing or damaging the floor by the base.

Although conceivable to utilize the dual pad configuration as described for the previous embodiments, it may be too dangerous with a tilting handle assembly.

Figure 5:
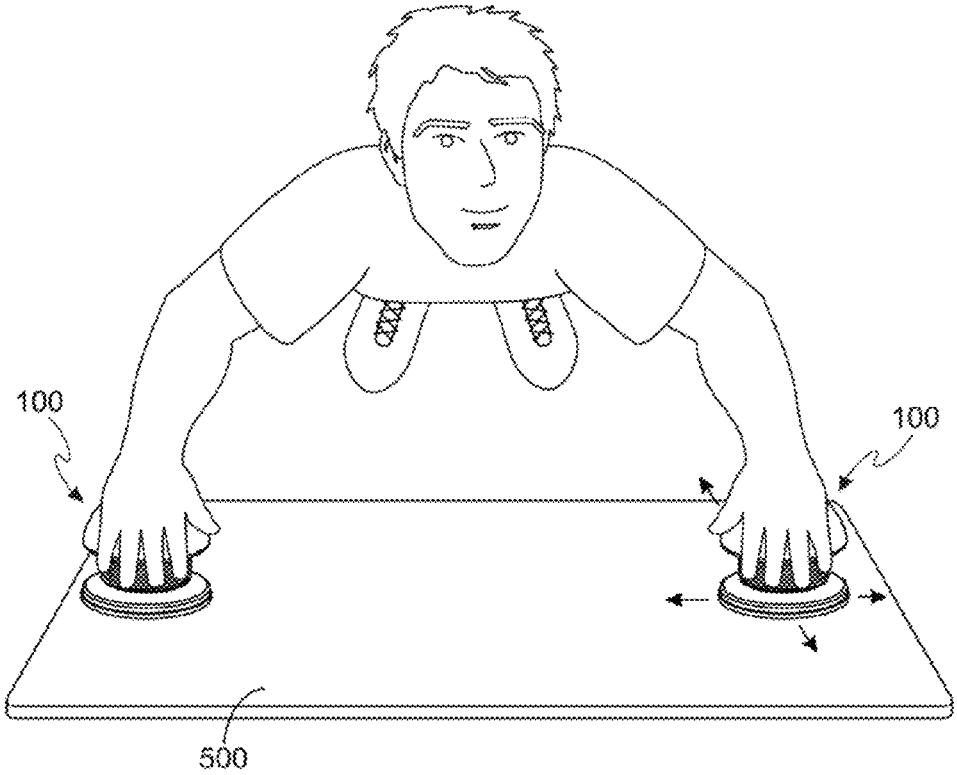
FIG. 5 shows the exercise device on a mat in use.

In some embodiments, as shown in FIG. 5, the exercise device may be provided with a slide mat 500 to perform the exercises upon. The slide mat 500 may have a smooth surface that allows the exercise devices 100, 200, 300, 400 to slide across the surface. The mat 500 may be thin and flexible so as to be rolled up for easy transportation and storage. In the preferred embodiment, the mat 500 may be made out of plastic.

A user can place a pair of exercise devices 100, 200, 300, or 400 (one for each hand) on the slide mat 500 with the proper pad 160 or 170 in place to allow the user to slide back and forth on the slide mat 500 with his hands the way an ice skater may skate on ice with his feet. Various other exercises can be conducted on the slide mat 500 involving sliding action with the pair of exercise devices as shown by the arrows. For example, the user can assume the push-up position with his feet secured and the exercise devices on the mat 500. From the push-up position, the user can slowly abduct his arms laterally away from his body to lower his body to the floor, then slowly adduct his arms towards the center to raise his body up. This exercise can be repeated for specific number of repetitions. In another exercise, the hands can move laterally to the side one at a time in an alternating fashion.

In another exercise, the user can assume the push-up position with his hands on the exercise devices 100, 200, 300, or 400 and extend his hands anteriorly in front of his head and then back again.

In another exercise, the user can combine these movements, for example, by laterally abducting both arms to the side then pushing his arms anteriorly and medial in front of the head and adducting his arms back towards his core back to his starting position.

In another exercise, the user can place the exercise device 100, 200, 300, or 400 on the floor or configure the exercise device with frictional pads and perform a wide variety of push-ups with his hands in various positions to change the intensity and difficulty of the exercise.

Figure 6:
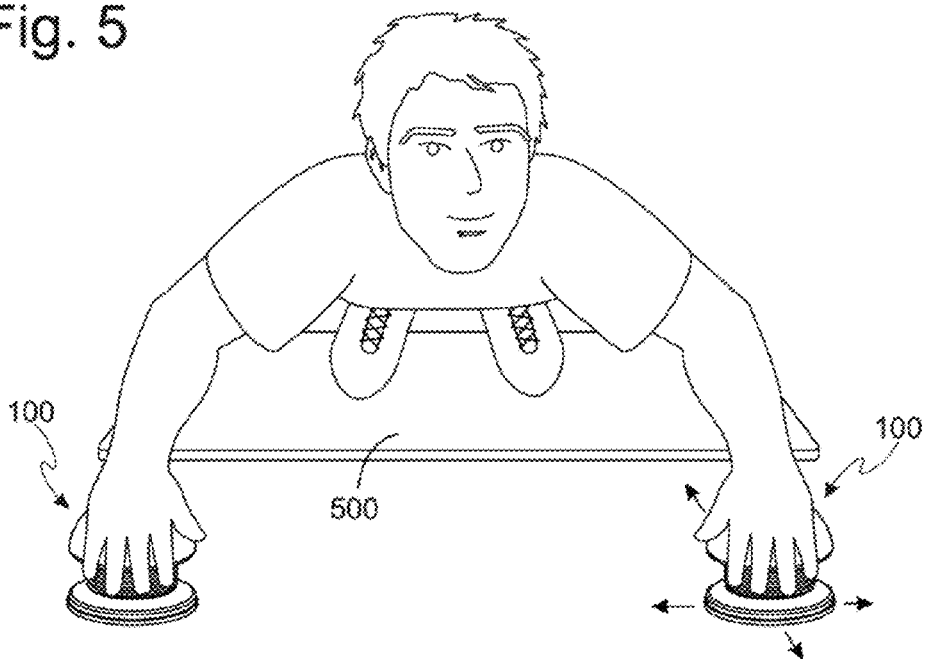
FIG. 6 shows another use of the exercise device with the mat.

In another exercise, the user may have his feet on the mat 500 and the exercise device 100, 200, 300, or 400 on the floor as shown in FIG. 6. This will allow the user to slide his feet along the mat 500 in various directions while supporting himself on the exercise device 100, 200, 300, or 400. The user may wear specific footwear 600 to provide the desired interface with the mat 500. For example, the footwear 600 may be socks or shoes with a slick surface to provide a sliding interface with the mat 500.

Figure 7:
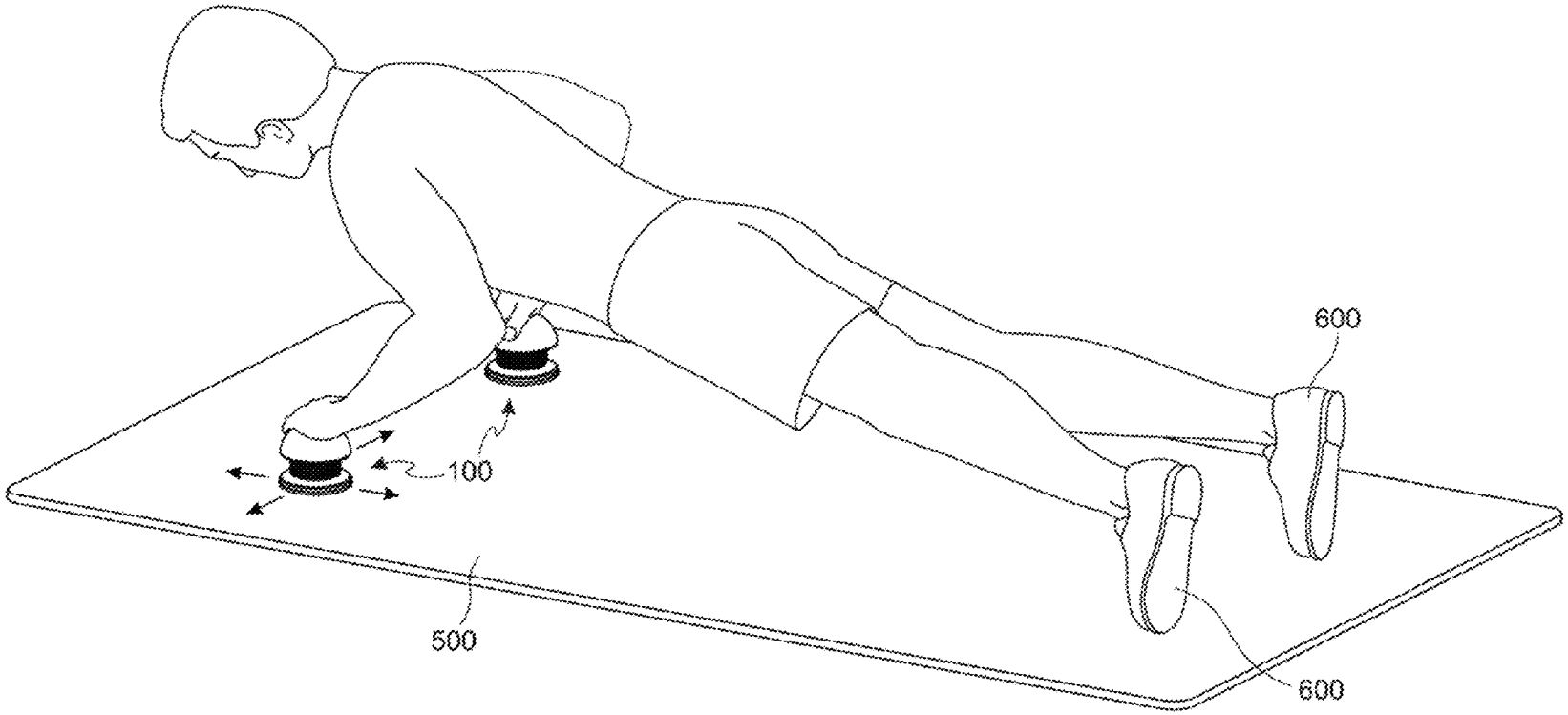
FIG. 7 shows another use of the exercise device with the mat.

In another exercise, the user may have the exercise device 100, 200, 300, or 400 and his feet on the mat 500 as shown in FIG. 7. The user can choose between a frictional surface or a slick surface for the exercise device to determine the type of exercises to perform. Footwear 600 may be worn to provide the proper interface between the mat 500 and the user's feet. In other words, the footwear 600 may provide a slick interface with the mat 500 so the feet can slide along the mat, or the footwear 600 may have a frictional interface to keep the feet fixed while the exercise device 100, 200, 300, or 400 is permitted to slide along the mat 500. In addition, both the footwear 600 and the exercise device 100, 200, 300, or 400 can both have frictional or slick contact with the mat 500 as well.

Many other exercises can be performed, alone or in combination, with any of the aforementioned exercises, whether it is with sliding hands and fixed feet, sliding feet and fixed hands, sliding hands and feet, or fixed hands and feet, with or without the mat 500. In combination with elevating, rotating, revolving, or tilting handle assemblies an endless combination of exercise movements can be performed for a total body workout.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An exercise device, comprising:

a. an ergonomic handle assembly having a first center, the ergonomic handle assembly, comprising:

i. a gripping handle providing a cushioned support for a user's hands; and ii. a handle support connected to the gripping handle;

b. an internal support having a second center, the internal support operatively connected to the handle assembly, wherein the internal support comprises a cylindrical sleeve operatively connected to the handle support, wherein the cylindrical sleeve is defined by an outer wall and an inner wall, wherein the inner wall defines a central cavity, and wherein the inner wall is threaded; and c. a foot support having a third center, the foot support operatively connected to the internal support to support the internal support and hand support assembly, wherein the foot support comprises as foot stand having a base and a connector, the connector protruding upwardly from the base, wherein the connector is threaded to connect with the threaded inner wall of the internal support to permit the handle assembly to move relative to the foot support, wherein the exercise device defines a central axis through the first, second, and third centers of the ergonomic handle assembly, the internal support, and the foot support, respectively, when in a neutral position.

2. The exercise device of claim 1, wherein the ergonomic handle assembly is generally hemispherical in shape, wherein the gripping handle comprises a generally convex outer surface and a generally concave inner surface, wherein the handle support comprises a generally convex outer surface and a generally concave inner surface, and wherein the generally convex outer surface of the handle support has a curvature that is substantially equal to a curvature of the generally concave inner surface of the gripping handle so that the generally concave inner surface of the gripping handle can mate with the generally convex outer surface of the handle support.

3. An exercise device, comprising:

a. a generally hemispherical handle assembly having a center, b. an internal support structure operatively connected to the generally hemispherical handle assembly; and c. a foot support operatively connected to the internal support structure to support the internal support structure and generally hemispherical handle assembly, the exercise device defining a central axis through the generally hemispherical handle assembly, the internal support structure, and the foot support, wherein the internal support structure and the foot support each comprise threading to allow the internal support structure to move up and down on the foot support along the central axis.

4. The exercise device of claim 3, wherein the generally hemispherical handle assembly, comprises:

a. a gripping handle providing a cushioned support for a user's hands, the gripping handle comprising a generally convex outer surface and a generally concave inner surface; and b. a handle support to moveably connect the generally hemispherical handle assembly to the internal support structure, the handle support comprising a generally convex outer surface and a generally concave inner surface, wherein the generally convex outer surface has a curvature that is substantially equal to a curvature of the generally concave inner surface of the gripping handle so that the generally concave inner surface of the gripping handle can mate with the generally convex outer surface of the handle support.

5. The exercise device of claim 4, wherein the generally concave inner surface of the handle support comprises a central deviation.

6. The exercise device of claim 5, wherein the central deviation is a shaft protruding away from the handle support along the central axis.

7. The exercise device of claim 6, wherein the foot support comprises a receiving hole to receive the shaft.

8. The exercise device of claim 6, wherein the shaft comprises a central channel.

9. The exercise device of claim 3, wherein the internal support structure comprises a generally cylindrical sleeve operatively connected to the generally hemispherical handle assembly, wherein the generally cylindrical sleeve is defined by an outer wall and an inner wall, wherein the inner wall defines a central cavity.

10. The exercise device of claim 9, wherein the inner wall of the sleeve comprises the threading on the internal support structure.

11. The exercise device of claim 3, wherein the foot support comprises a foot stand having a base and a connector, the connector protruding upwardly from the base to connect with the internal support structure, wherein the connector comprises an outer wall.

12. The exercise device of claim 11, wherein the outer wall of the connector is threaded.

13. The exercise device of claim 11, wherein the base comprises a peripheral channel into which a first pad can be seated.

14. The exercise device of claim 11, wherein the foot stand defines a central void.

15. The exercise device of claim 14, wherein a first pad is housed inside the central void in a manner so as to protrude below the base to raise the base off a surface.

16. The exercise device of claim 15, wherein the first pad is adjustable within the central void so as to adopt two configurations, wherein in a first configuration the first pad contacts the surface, and wherein in a second configuration the base contacts the surface.

17. The exercise device of claim 16, wherein the base comprises a peripheral channel into which a second pad can be seated so that in the second configuration the second pad of the base contacts the surface.

18. The exercise device of claim 17, wherein the first and second pads are selected from the group consisting of a sliding pad and a friction pad, wherein the first pad is not the same as the second pad.

* * * * *